US010858907B2

(12) United States Patent
Cervo et al.

(10) Patent No.: US 10,858,907 B2
(45) Date of Patent: Dec. 8, 2020

(54) LINER CONVEYED STAND ALONE AND TREAT SYSTEM

(71) Applicant: Halliburton Energy Services, Inc., Houston, TX (US)

(72) Inventors: Gustavo Dias De Castro Cervo, Carrolton, TX (US); Nicholas Albert Kuo, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/097,534

(22) PCT Filed: Mar. 5, 2018

(86) PCT No.: PCT/US2018/020941
§ 371 (c)(1),
(2) Date: Oct. 29, 2018

(87) PCT Pub. No.: WO2018/165035
PCT Pub. Date: Sep. 13, 2018

(65) Prior Publication Data

US 2019/0153810 A1 May 23, 2019

Related U.S. Application Data

(60) Provisional application No. 62/467,293, filed on Mar. 6, 2017.

(51) Int. Cl.
*E21B 33/14* (2006.01)
*E21B 43/08* (2006.01)
(Continued)

(52) U.S. Cl.
CPC ..... *E21B 33/14* (2013.01); *E21B 23/06* (2013.01); *E21B 33/12* (2013.01); *E21B 43/045* (2013.01);
(Continued)

(58) Field of Classification Search
CPC ..... E21B 33/14; E21B 33/12; E21B 33/146; E21B 33/16; E21B 43/10; E21B 43/108; E21B 43/25; E21B 43/26
See application file for complete search history.

(56) References Cited

U.S. PATENT DOCUMENTS 5,746,274 A 5/1998 Voll et al.
6,543,545 B1 * 4/2003 Chatterji ..... E21B 43/04 166/207
(Continued)

FOREIGN PATENT DOCUMENTS

WO 2006041825 A2 4/2006
WO 2006041825 A3 6/2006
WO 2012066290 A2 5/2012

OTHER PUBLICATIONS

Halliburton, Solving Challenges, Liner-Conveyed Gravel Pack (LCGP) System, 2015.
(Continued)

*Primary Examiner* — Crystal J Miller
(74) *Attorney, Agent, or Firm* — Scott Richardson; Parker Justiss, P.C.

(57) ABSTRACT

A well completion assembly and method including apparatus for setting a liner hanger, screens and liner within a wellbore, performing an acid treatment and cementing a liner in a single trip.

20 Claims, 14 Drawing Sheets

(51) Int. Cl.

| | |
|---|---|
| ***E21B 43/10*** | (2006.01) |
| ***E21B 23/06*** | (2006.01) |
| ***E21B 43/04*** | (2006.01) |
| ***E21B 33/12*** | (2006.01) |
| ***E21B 43/26*** | (2006.01) |

(52) U.S. Cl.
CPC ..... *E21B 43/08* (2013.01); *E21B 43/10* (2013.01); *E21B 43/26* (2013.01); *E21B 43/04* (2013.01)

(56) References Cited

U.S. PATENT DOCUMENTS

| | | | |
|---|---|---|---|
| 6,729,393 | B2 | 5/2004 | Vincent et al. |
| 7,337,840 | B2 | 3/2008 | Penno |
| 8,479,810 | B2 | 7/2013 | Metcalfe |
| 2003/0085037 | A1 | 5/2003 | Roane et al. |
| 2006/0076133 | A1 | 4/2006 | Penno |
| 2007/0095533 | A1* | 5/2007 | Rogers ..... E21B 21/10 166/285 |
| 2008/0110620 | A1* | 5/2008 | Penno ..... E21B 43/045 166/278 |
| 2013/0000899 | A1 | 1/2013 | Broussard et al. |
| 2014/0251609 | A1* | 9/2014 | Broussard ..... E21B 43/04 166/278 |

OTHER PUBLICATIONS

Inernational Searching Authority, Patent Cooperation Treaty, International Search Report and Written Opinion, International Application No. PCT/US2018/020955, which is a PCT parent to the instant application, dated Jun. 21, 2018.

International Searching Authority, Patent Cooperation Treaty, International Search Report and Written Opinion, International Application No. PCT/US2018/020941, which is a PCT parent to the instant application, dated Jun. 22, 2018.

* cited by examiner

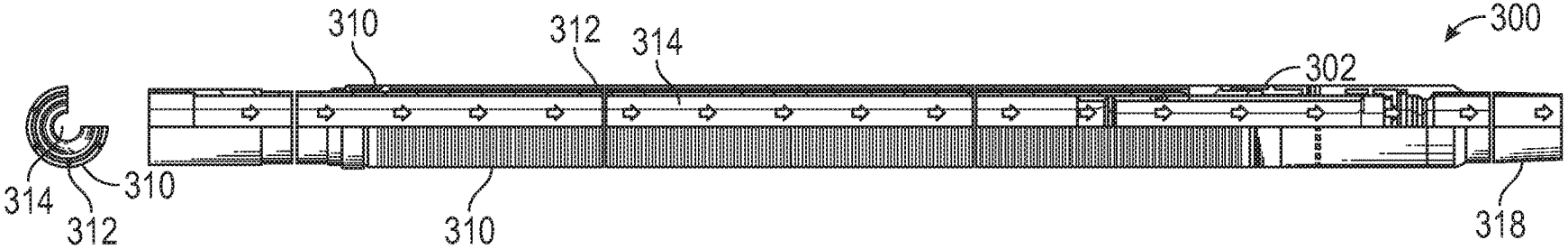
FIG. 11A
FIG. 11B
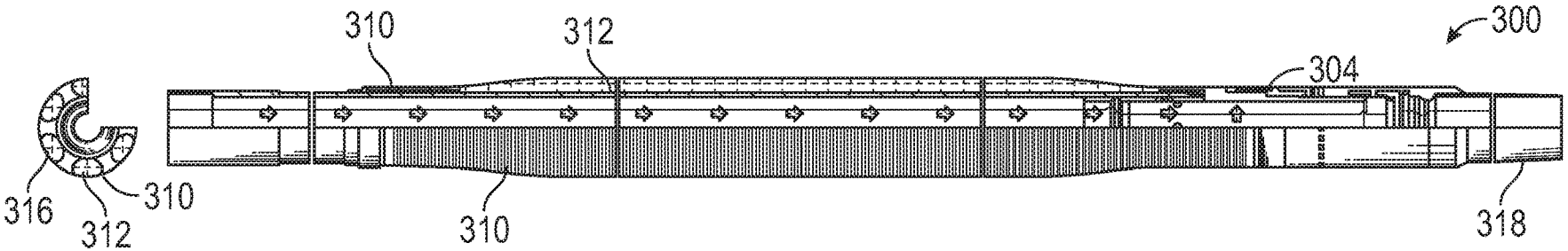
FIG. 11C
FIG. 11D
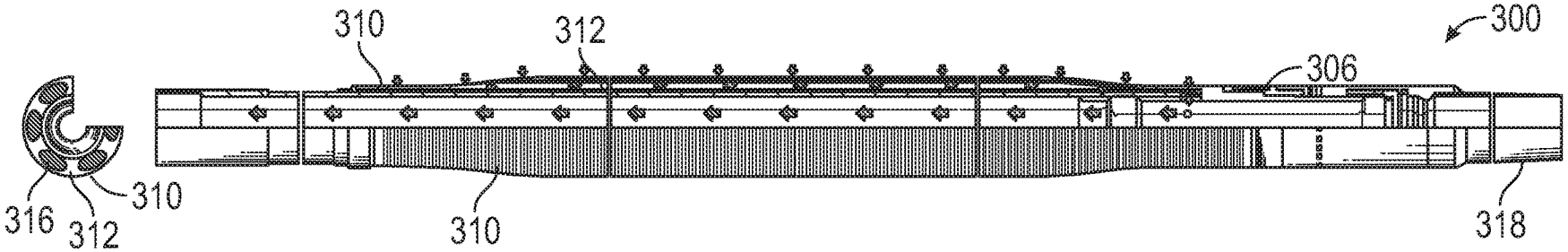
FIG. 11E
FIG. 11F

LINER CONVEYED STAND ALONE AND TREAT SYSTEM

BACKGROUND

Hydrocarbon producing wells are often completed in unconsolidated producing formations containing fines and sand that can flow with produced hydrocarbons (fluids or gas) from the formations. The solid particulates in the produced fluids flow stream can damage equipment and must be removed from the produced fluids. Following drilling of a wellbore through an unconsolidated formation it is often a requirement that the wellbore be completed with a device that retains the sand particles in the formation, but that allows the flow of fluids to be produced. Filters, such as for example, sand screens, are commonly installed in wellbores and a gravel pack operation can be performed adjacent the screen to assist with the filtering out the fines and sand in the produced fluids and in the stabilizing of the producing formation.

The portion of the well above the productive formation is usually lined with one or more steel casing. The annulus between the casing and the wellbore is typically filled with cement to stabilize the casing and prevent fluid flows within the annulus. The wellbore can then be drilled further to drill through the productive formation. A length of blank pipe may be run to provide a second casing (often referred to as a liner) in the wellbore below the existing casing to a location just above the productive formation. At least a portion of the annulus between the liner and the open hole below the casing is normally filled with cement to hold the liner in place and block annular flow of fluids around the liner. A screen assembly can then be run below the liner into the open hole zone to provide a flow path for produced fluids from the producing formation, through the screen and liner and to the cased portion of the well. A flow conduit for produced fluids within the cased portion of the well to the surface is typically a production tubing string.

A well completion in an open hole zone generally requires both a gravel packing operation and a cementing operation. These operations have typically been performed using separate stages and multiple sets of equipment run into the well at different times. For example, a liner may be placed in the well and a cementing assembly may be run into the well to perform cementing of the liner. Once cementing of the liner is completed the cementing assembly is typically removed from the well and a screen and a gravel packing assembly run into the well for gravel packing the screen. Thus, multiple trips into the well have typically been required to place the liner and the screen within the well and to cement the liner and gravel pack the screen. Each trip into the well to position equipment or perform an operation requires additional time and expense and presents a challenge.

BRIEF DESCRIPTION OF THE DRAWINGS

FIG. 11*a* through 11*f* illustrate cross-sectional and sectional views of an expandable screen assembly according to an embodiment, at its Run-in state, Activation state, and Productive state in accordance with certain embodiments of the present disclosure.

DETAILED DESCRIPTION

Figure 1:
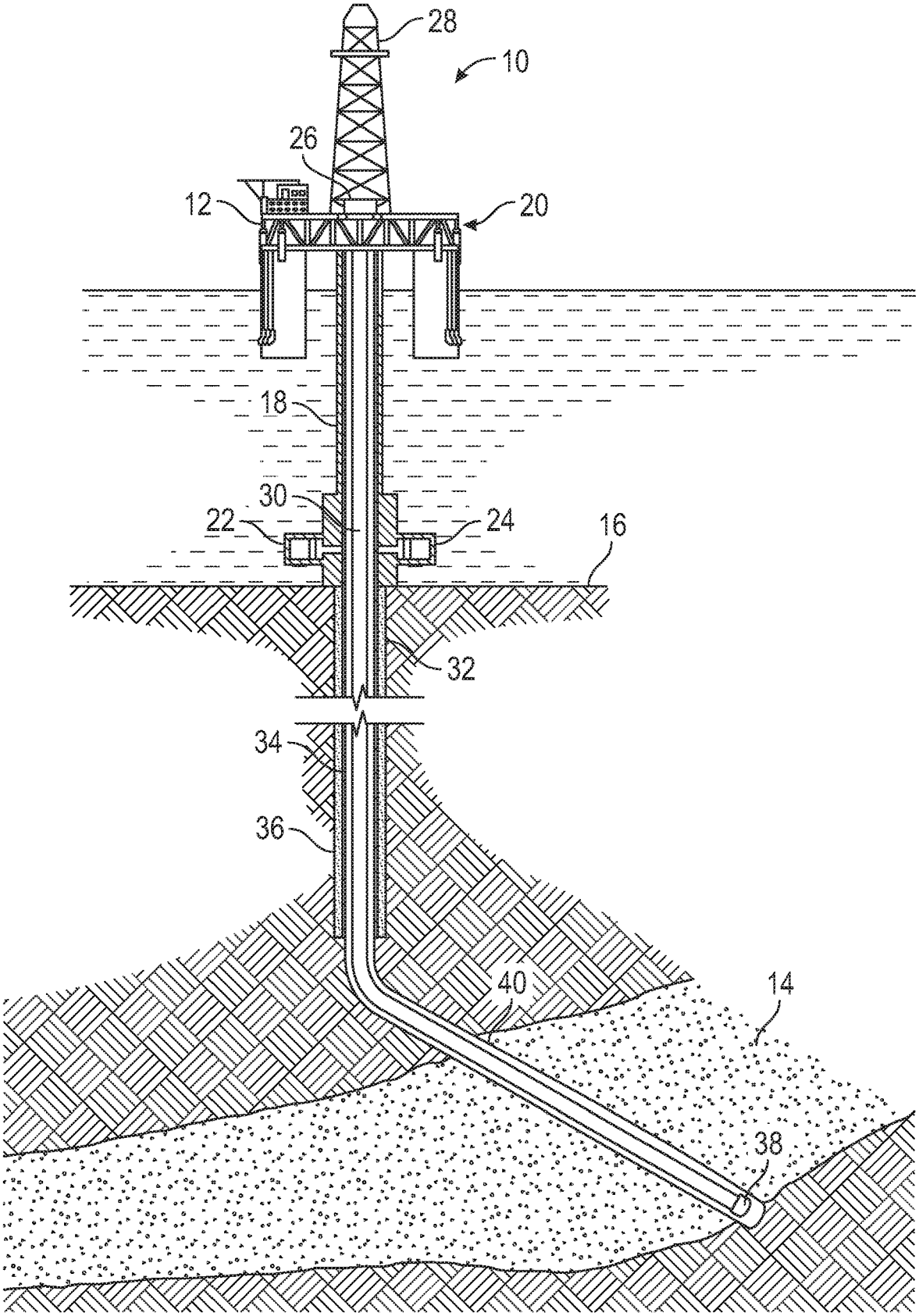
FIG. 1 is a schematic illustration of an offshore oil and gas platform and the drilling of a wellbore through a subterranean formation.
Figure 2A:
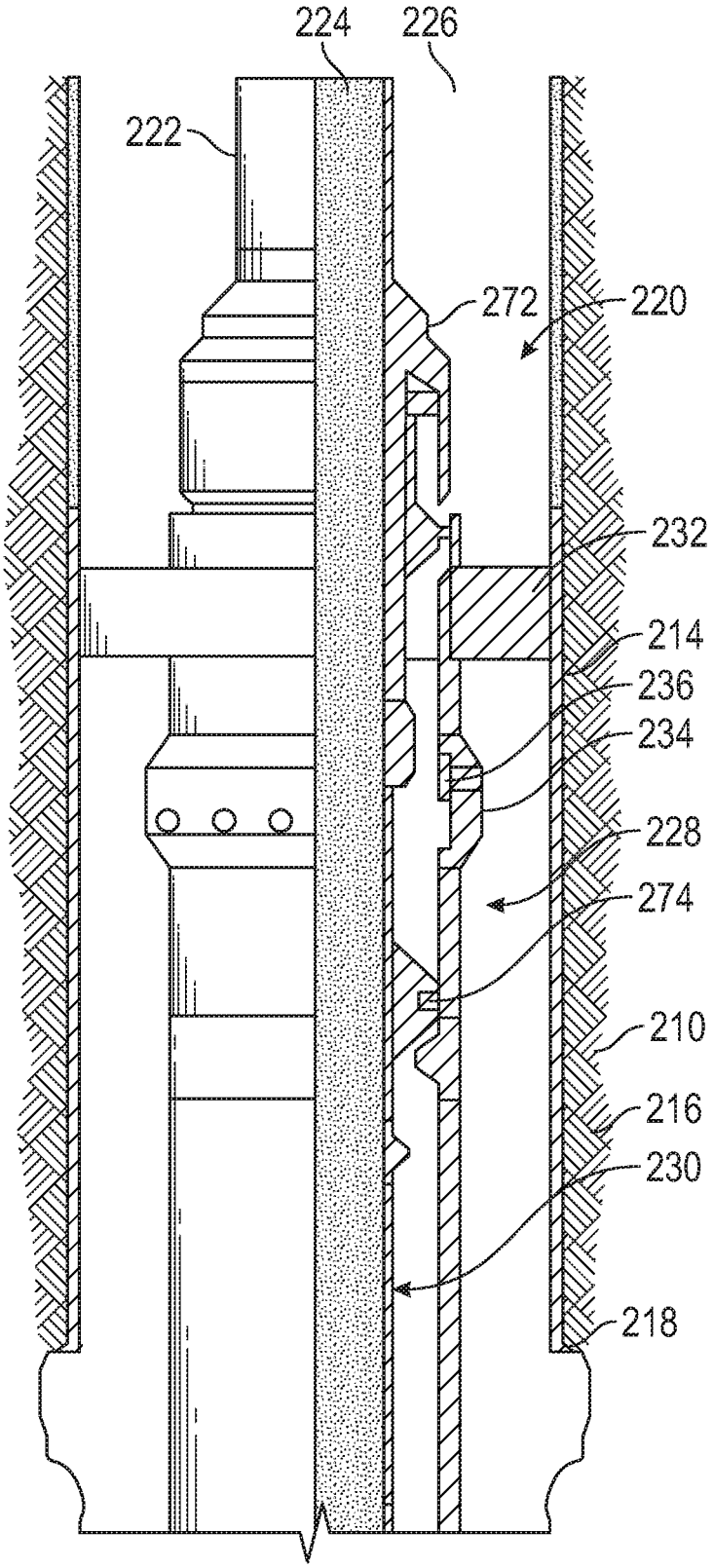
FIGS. 2*a*-2*d* illustrate an elevation sectional view of an assembly according to an embodiment, as positioned in a well in preparation for well treating and cementing in accordance with certain embodiments of the present disclosure.
Figure 2B:
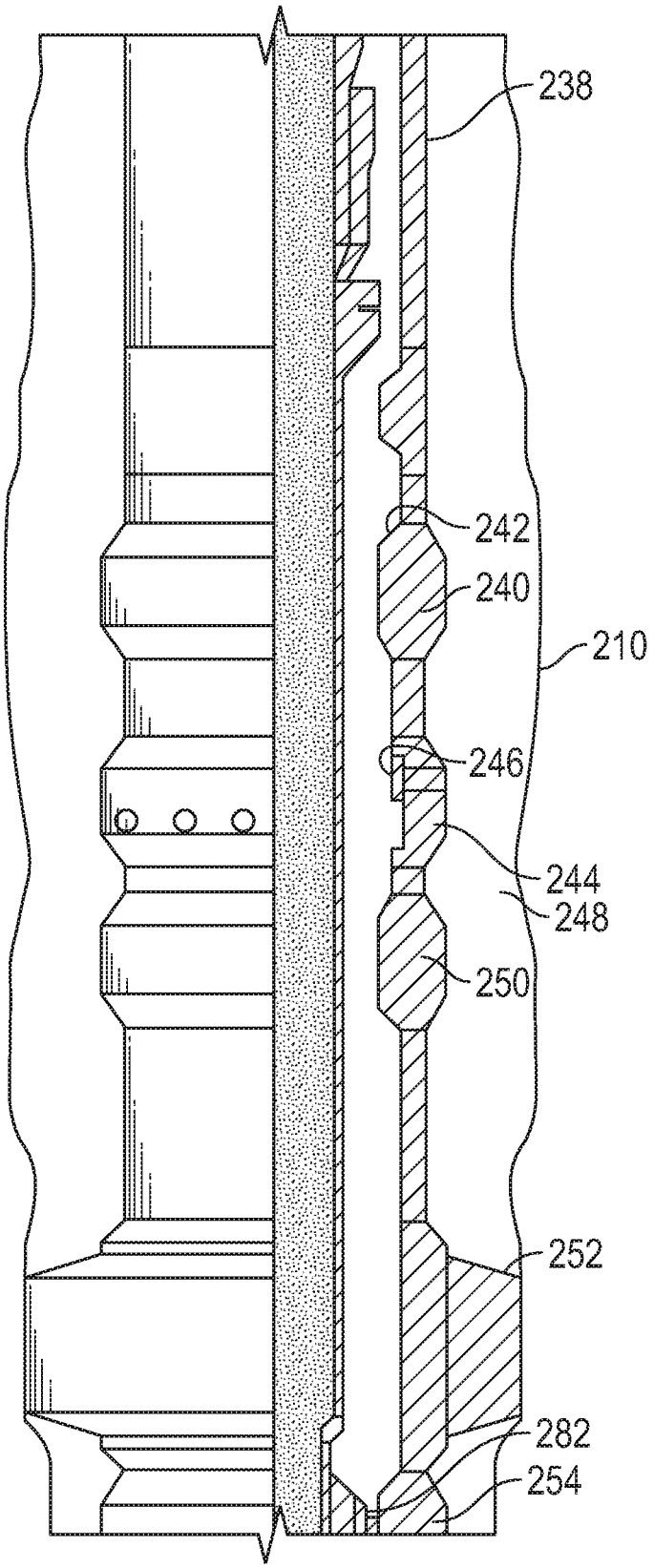
Figure 2C:
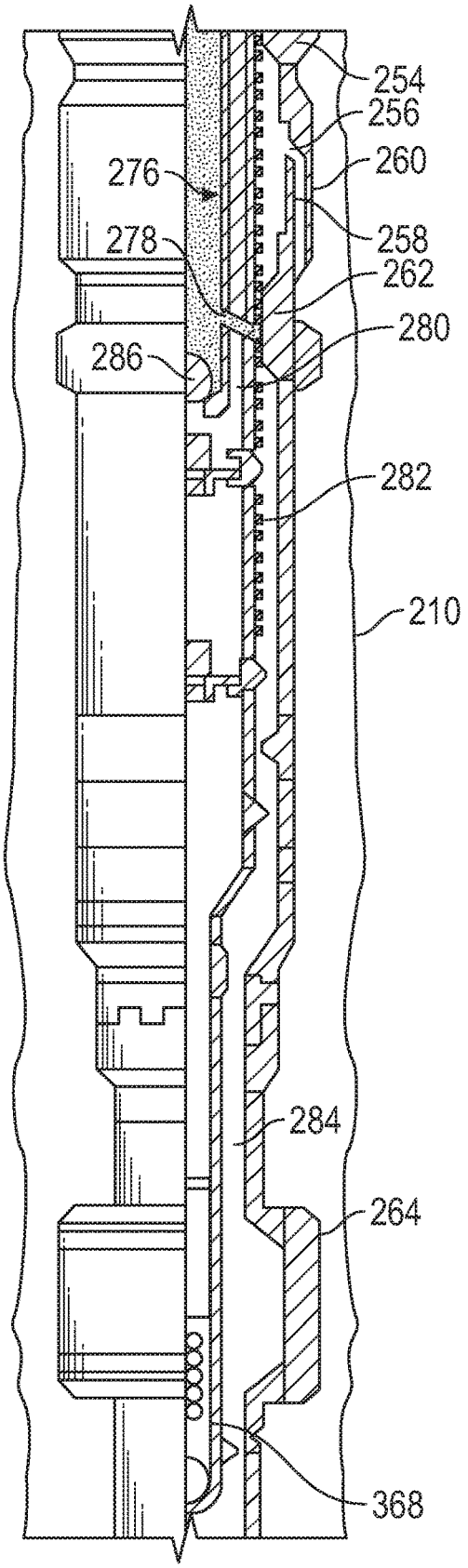
Figure 2D:
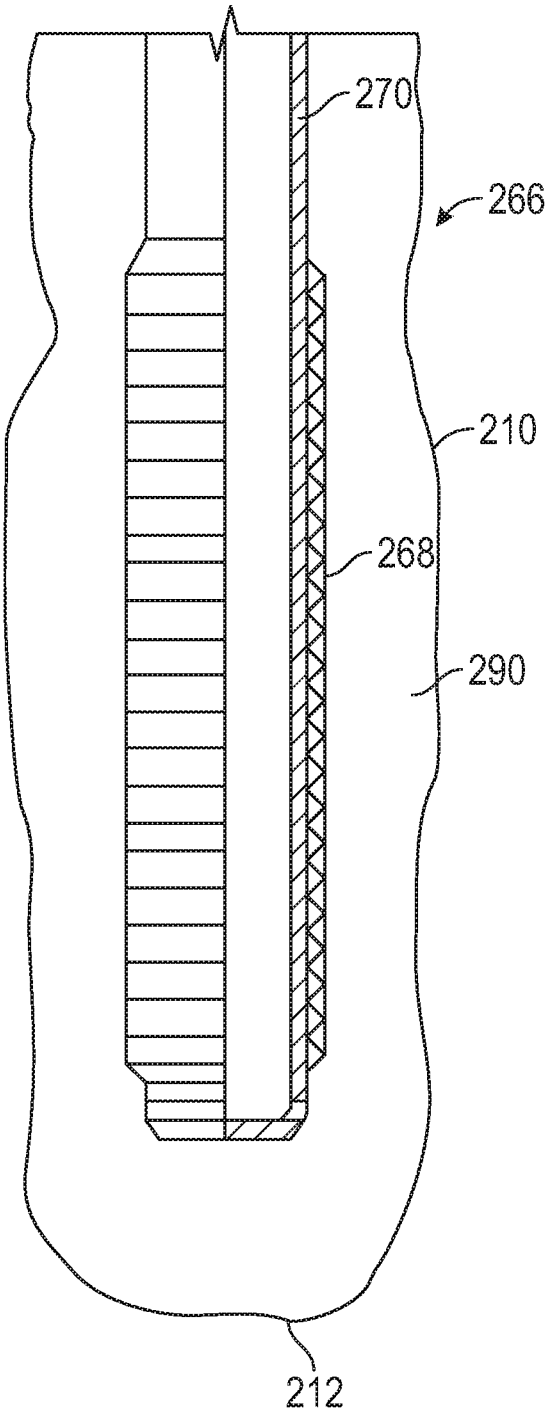

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope or applications of the appended claims. In particular, an element associated with a particular embodiment should not be limited to association with that particular embodiment but should be assumed to be capable of association with any embodiment discussed herein.

Various elements of the embodiments are described with reference to their normal positions when used in a borehole. For example, a screen may be described as being below or downhole from a crossover. For vertical wells, the screen will actually be located below the crossover. For horizontal wells, the screen will be horizontally displaced from the crossover, but will be farther from the surface location of the well as measured through the well. Downhole or below as used herein refers to a position in a well farther from the surface location in the well.

An annulus, as used in the embodiments, is generally a space between two generally cylindrical elements formed when a first generally cylindrical element is positioned inside a second generally cylindrical element. For example, a liner is a cylindrical element which may be positioned in a wellbore, the wall of which is generally cylindrical forming an annulus between the liner and the wellbore. While drawings of such arrangements typically show the inner element centrally positioned in the second, it should be understood that inner element may be offset and may actually contact a surface of the outer element at some radial location, e.g. on the lower side of a horizontal well. The width of an annulus is therefore typically not the same in all radial directions.

Cementing operations in a well and equipment used for such operations are generally well known in the well completion field. In general, the equipment provides a flow path through which cement may be flowed from a work string into an annulus between a casing, liner, or other oilfield tubular element and a well. Since the well is normally filled with a fluid, e.g. drilling fluid, completion fluid, etc., the equipment also includes a return flow path for fluid displaced by cement during the cementing operation.

Gravel packing operations in a well and equipment used for such operations are also generally well known in the well completion field. A complete gravel packing assembly may be considered to include a screen or other filter element and length of blank pipe extending from the screen, both of which are to be installed in a well, as well as equipment for placing a gravel pack around the screen in the well. The gravel packing equipment typically includes a work string having a packer and cross over assembly and a wash pipe extending below the cross over to the bottom of the screen. When properly positioned for a gravel packing operation, the packer seals the annulus between the work string and the well above the screen. A gravel packing slurry, i.e. liquid plus a particulate material, is then flowed down the work string to the crossover which directs the slurry into the annulus below the packer. The slurry flows to the screen which filters out the particulate to form a gravel pack around the screen. The fluid flows through the screen into the wash pipe back up to the crossover which directs the return flow into the annulus above the packer. A packer may be used between the work string and the casing, liner, etc. to prevent cement from entering the annulus between the work string and the casing, liner, etc.

A well completion in an open hole zone generally requires the running of a liner, a cementing operation, the running of a screen, and a gravel packing operation. These completion operations are well known but are typically performed using multiple sets of equipment run into the well at different times. For example, a liner may be placed in the well and a cementing assembly may be run into the well to perform cementing of the liner. Once cementing of the liner is completed the work string with the cementing assembly is typically removed from the well and a screen and a gravel packing assembly run into the well for gravel packing the screen. Thus, multiple trips into the well have typically been required to place the liner and the screen within the well and to cement the liner and gravel pack the screen. Each trip into the well to position equipment or perform an operation requires additional time and expense. Further the screen assembly will need to have a smaller diameter to enable it to be run through the liner, which can lead to a restriction on the productive capacity of the well and induce constraints on future intervention operations.

The one trip liner conveyed screen system of the present disclosure provides an apparatus for selectively providing flow paths through a single work string for screen positioning and screen setting, liner placement and cementing, circulation paths for cleaning and, if desired, activating annular barriers. The flow path selection can be provided by sliding seals, sleeves, or ports formed between the work string and the liner/screen assembly. The selection of the flow path can be made by lifting and lowering the work string relative to the liner/screen assembly and/or by varying the fluid pressure within the work string. The movement of the work string relative to the liner/screen assembly can be performed at the surface location of the well by lifting and lowering the work string. Alternate means for selecting flow paths can also be used. The one trip liner conveyed screen system of the present disclosure provides for the screen to have a larger diameter than a screen assembly that is required if it were to be run through the liner.

FIG. 1 is a schematic illustration of an offshore oil and gas platform and the drilling of a wellbore through an oil and gas formation and is generally designated 10. A semi-submersible platform 12 is located over a submerged oil and gas formation 14 located below the sea floor 16. A subsea conduit 18 extends from the deck 20 of platform 12 to a wellhead installation 22 that includes blowout preventers 24. Platform 12 has a hoisting apparatus 26 and a derrick 28 for raising and lowering pipe strings, such as a substantially tubular, longitudinally extending drill string or work string.

Although FIG. 1 depicts an offshore slanted well from a semi-submersible platform, it should be understood that the open hole completion operations of the present disclosure are equally well-suited for use on onshore wells or alternative type offshore wells, in vertical wells, horizontal wells, multilateral wells and the like.

A wellbore 32 extends through the various earth strata including formation 14. A casing 34 is shown cemented within a vertical section of wellbore 32 by cement 36. A drill string 30 extends from the deck 20 of platform 12, through the wellhead installation 22, including blowout preventers 24, and has a drill bit 38 on the distal end. The open hole section 40 extends the wellbore 32 below the casing 34 and through formation 14.

FIGS. 2*a* through 2*d* illustrate an embodiment of the present disclosure positioned in a well bore 210 extending from a surface location, not shown, to a bottom hole location 212. A casing 214 has been placed in an upper portion of the well 210 and the annulus between the casing 214 and well 210 has been filled with cement 216. Casing 214 may be nominal nine and five/eighth inch steel casing. Below the bottom of the casing 214 or casing shoe 218, the well 210 remains in an open hole, i.e. uncased, condition. In many cases, the casing 214 is placed in an upper portion of well 210 and the open hole portion of the well 210 includes slanted, curved or otherwise deviated portions so that at the bottom hole location 212, the well is horizontal or near horizontal. The present disclosure is suitable for use in wells which are vertical to the bottom hole location 212 or which are slanted or deviated or horizontal over portions of their length.

An assembly 220 according to the present disclosure is shown positioned in the well 210 extending from the casing 214 down to near the bottom hole location 212. The assembly 220 has been lowered into position on a work string 222 extending from the surface location of the well 210. A work string for purposes of the present disclosure may be any known pipe have the necessary strength and size to be lowered into and removed from a well 210 to position equipment in the well, flow materials into or from the well for various known operations, etc. A work string 222 may comprise any suitable oilfield tubular element including drill pipe, production tubing, etc. The work string 222 provides a first flow path 224 inside the work string 222 and a second flow path 226 in the annulus between the work string 222 and the casing 214. Fluids may be circulated from the surface down path 224 and back up annulus 226 or reverse circulated down annulus 226 and back up the path 224.

The assembly 220 includes an outer assembly 228 and an inner assembly 230. Inner assembly 230 is connected to the lower end of work string 222 throughout its use in the present disclosure so that it is run into the well 210 on the work string 222 and removed from the well 210 with the work string 222. The inner assembly may therefore be considered part of the work string 222. The outer assembly 228 is mechanically coupled to the inner assembly when the inner assembly 230 is run into the well 210, but, as explained below, is thereafter mechanically coupled to the casing 214 and disconnected from the inner assembly 230, allowing the inner assembly 230 to be repositioned relative to the outer assembly 228 by movements of the work string 222 from the surface location of the well 210.

The outer assembly includes a packer 232, which is shown inflated into sealing contact with the casing 214. Packer 232 may be a combination packer hanger to resist axial movement of the outer assembly 228 in the well 210, or may be only a hanger. In an embodiment, the packer 232 provides a fluid tight seal between the outer assembly 228 and the casing 214 as well as mechanically coupling the outer assembly 228 to the casing 214. Below the packer 232 is located an upper cementing port 234 including a sleeve valve 236 allowing the port 234 to be selectively opened or closed. In the run in position, the valve 236 is closed. Below port 234 is located a length of blank pipe 238. Blank pipe 238 is a conventional oil field tubular element, for example steel pipe and may be referred to as a liner because a portion of it may be positioned within the casing 214. In this embodiment, pipe 238 may have a nominal diameter of seven inches and a weight of twenty-three pounds per foot. The length of pipe 238 may be selected based on the distance from the casing shoe 218 to the producing formation or the required position of screens. The pipe 238 is capable of passing through curved or deviated portions of the well 210 and may be of considerable length. The various other elements comprising the outer assembly 228 are connected together by various other sections of pipe 238 and/or collars, etc. In some applications, for example in a shallow well, it may be desirable for the pipe 238 to extend a considerable distance up the well 210 and possibly to the surface location and pipe 238 may replace the casing 214.

Below pipe 238 is located a seal bore 240 having an inner sealing surface 242. In this embodiment, the seal bore 240 may comprise a thick wall coupling or length of pipe having a polished inner seal bore surface 242 having a precise inner diameter, e.g. five inches, which is less than the minimum inner diameter of the pipe 238. Alternatively, the seal bore 240, and other seal bores used in the present disclosure, may be a coupling or length of pipe having an inner sealing surface 242 formed of an elastomeric material, e.g. one or more O-rings. As described in more detail below, the inner assembly 230 may carry an outer seal body to seal with the sealing surface 242. If the sealing surface 242 is a polished metal surface, the inner assembly may carry a matching elastomeric seal body. If the sealing surface 242 comprises an elastomeric element, then, the inner assembly may carry a matching polished metal seal body.

Below seal bore 240 is located a lower cementing port 244 including a sleeve valve 246 allowing the port 244 to be selectively opened or closed. In the run in position, the valve 246 is closed. The lower cementing port 244 can also include a spring biased one-way valve, i.e. check valve, which allows fluids to flow out of the port 244 into the annulus 248, but blocks flow of fluids from the annulus 248 into the port 244. Other forms of flow direction biased one-way valves may be used if desired. Such a valve may be omitted if desired and may provide no benefit in some situations, for example if the entire interval to be cemented is horizontal. A second seal bore 250 is located below the port 244.

An external casing packer 252 is located below the second seal bore 250. Below the packer 252 is located a third seal bore 254. Below seal bore 254 is located a valved port 256. The valved port 256 includes a sleeve valve 258, which is typically in its open position when the assembly 220 is run in the well. The valved port 256 preferably includes an outer shroud 260, which directs fluids flowing out of valved port 256 down hole to avoid erosion of the wall of borehole 210. A fourth seal bore 262 is positioned below the valved port 256. Below the seal bore 262 is located a fluid loss control device 264. The fluid loss control device 264 can be any type of suitable fluid loss control devices, e.g. a ball valve, flapper valve, or other type of device may be used.

A screen assembly 266 is located below the fluid loss control device 264. The screen assembly includes a screen 268 that may be any conventional or premium screen. Other forms of filters, such as slotted pipe or perforated pipe, may be used in place of screen 268 if desired. Above screen 268, a length of blank pipe 270 connects the screen 268 to the upper portions of the outer assembly 228. The pipe 270 may be of smaller diameter than the pipe 238, as illustrated. In some embodiments, the pipe 270 and base pipe used in the screen 268 may be of the same diameter as the blank pipe 238. In alternate embodiments, the pipe 270 and base pipe used in the screen 268 may have a larger diameter as the blank pipe 238.

The inner assembly 230 includes a packer setting tool 272 at its upper end connected to work string 222. The tool 272 is used to set the packer 232 and to release the outer assembly 228 from the work string 222 once the packer 232 is set. The inner assembly includes shifters, e.g. 274, for opening and closing the sleeve valves 236, 246 and 258 as the inner assembly 230 is moved down and up in the well 210. The inner assembly 230 includes a crossover assembly shown generally at 276. The crossover 276 includes a port 278 in fluid communication with the flow path 224 through work string 222. It also includes a flow path 280 in fluid communication with the flow path 226 above packer 232.

On a cylindrical outer surface of crossover 276 is carried a seal unit or seal body 282 extending above and below the port 278. The seal unit 282 may be formed as a separate metal sleeve having a plurality of elastomeric rings on its outer surface. The outer diameter of the elastomeric rings may be slightly greater, e.g. 0.010 to 0.025 inch greater, than the inner diameter of the seal bores 240, 250, 254 and 262. In this embodiment, the seal bores 240, 250, 254 and 262 have polished metal inner surfaces, e.g. 242, with which such elastomeric rings may form fluid tight seals. In an alternative discussed above, the inner surfaces of seal bores 240, 250, 254 and 262 are formed by elastomeric elements such as O-rings. In this alternative, the seal body 282 may comprise only a metal sleeve having a polished outer surface having an outer diameter somewhat larger than the inner diameter of the elastomeric elements forming the inner sealing surfaces, e.g. 242, of the seal bores 240, 250, 254 and 262. In either case, the seal body 282 may form fluid tight seals with the seal bores 240, 250, 254 and 262 at any point along the length of the seal body 282. The seal body 282 has sufficient length above and below the port 278 to form seals with seal bores 240 and 250 at the same time and with seal bores 254 and 262 at the same time.

The lowermost portion of the inner assembly 230 can comprise wash pipe 284, and a fluid loss control device shifter 368 that can be used to open or close the fluid loss control device 264 located above the screen.

In FIGS. 2*a*-2*d*, the assembly 220 is shown in its run in position in well 210 and with the packer 232 set. The packer 232 was set by dropping a ball 286 down the work string 222. Before the ball 286 is dropped, the assembly 220 allows full fluid circulation in the well as the work string 222 and assembly 220 are run into the well. The packer setting tool 272 and pressure in the flow path 224 may be used to set the packer 232. After the packer 232 has been set, the well may be pressure tested by increasing pressure in the annulus 226.

In the run in position shown in FIG. 2, the cross over port 278 is located at the lowermost seal bore 262 below the valved port 256. The seal body 282 contacts the seal bore 262 both above and below port 278, blocking all flow into or out of the port 278. Once the ball 286 is in place, the flow path 224 is isolated from the annulus 248 and annulus 226. After pressure testing the packer 232, the pressure in the annulus 226 may be increased to set packer 252, as illustrated in FIGS. 3-7.

Figure 3:
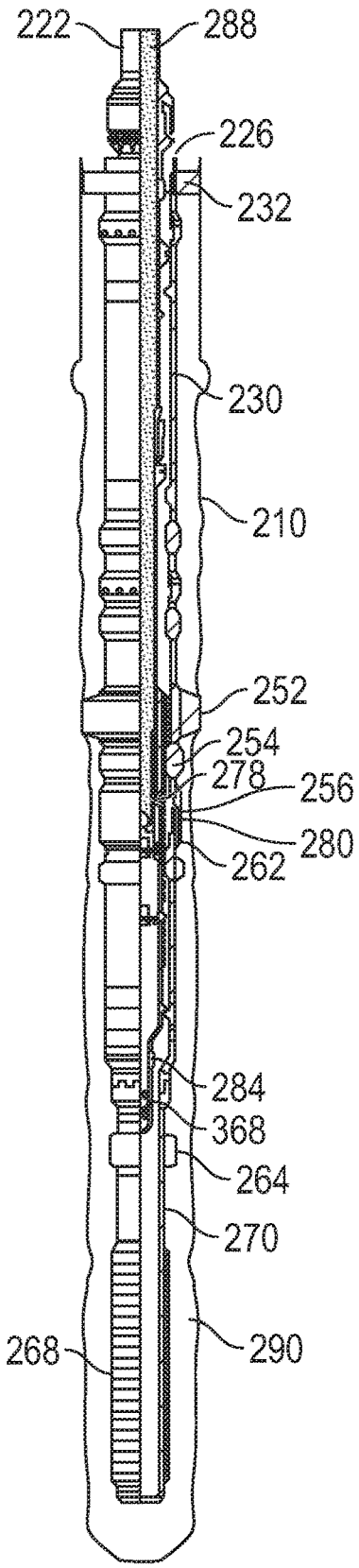
FIG. 3 is an elevation sectional view of FIG. 2, with an inner assembly in a well treating position in accordance with certain embodiments of the present disclosure.

The use of the apparatus of FIGS. 2*a*-2*d* will be described with reference to FIGS. 3-9. After the packers 232 and 252 have been set, as shown in FIG. 3, the inner string 230 may be repositioned for treating a portion of the well 210. By lifting the work string 222, the cross over port 278 may be positioned in fluid communication with the valved port 256. This is achieved by positioning seal body 282 to contact the seal bores 254 and 262 above and below crossover port 278 respectively. A treatment fluid 288, such as an acid treatment, may then be flowed from the surface down work string 222 and through port 278 and valved port 256 into the annulus 290 adjacent the screen 268. The displaced liquid flows up the wash pipe 284, through crossover path 280 and into the annulus 226 which can then flow back to the surface location of well 210.

In the FIG. 3 configuration, the present disclosure may be used to perform pressurized treatments. In some cases it may be desirable to perform a pressurized treatment such as acidizing which requires flowing a fluid down the work string 222 and into the formation surrounding the screen 268. In the FIG. 3 configuration, any treating fluid may be flowed down the work string 222 and pumped into the annulus 290 around the screen 268. By blocking return flow through the annulus 226, pressure may be applied to force the fluid into the formation surrounding the screen 268. The present disclosure provides a convenient system for selectively treating the production zone surrounding the screen 268.

Figure 4:
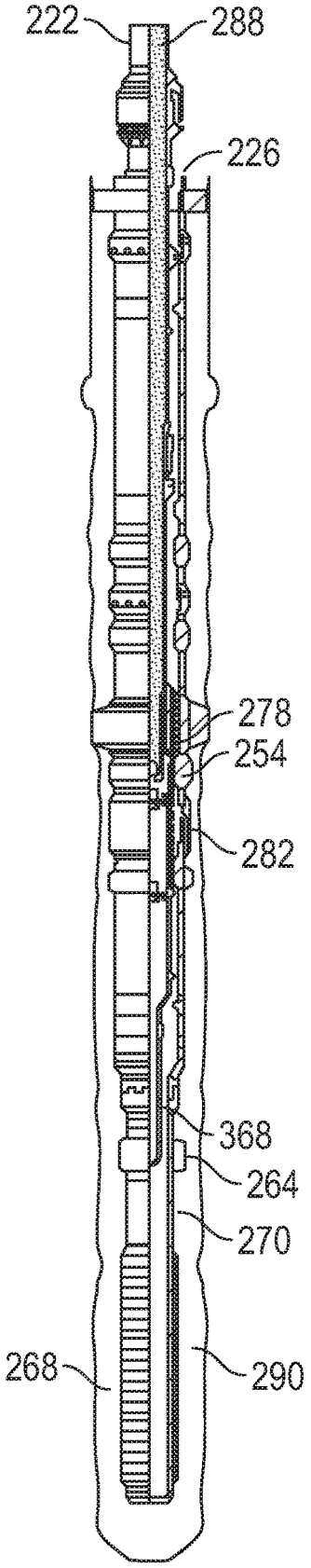
FIG. 4 is an elevation sectional view of FIG. 2, with an inner assembly in a reverse circulation position after well treating in accordance with certain embodiments of the present disclosure.

In FIG. 4, the work string 222 has again been lifted to move the cross over port 278 above the seal bore 254 while leaving the seal body 282 in sealing contact with the seal bore 254 below port 278. In this position, fluid may be reverse circulated down the annulus 226, into crossover port 278 and up the work string 222 to remove any remaining treating fluid from the annulus 226 and work string 222.

Figure 5:
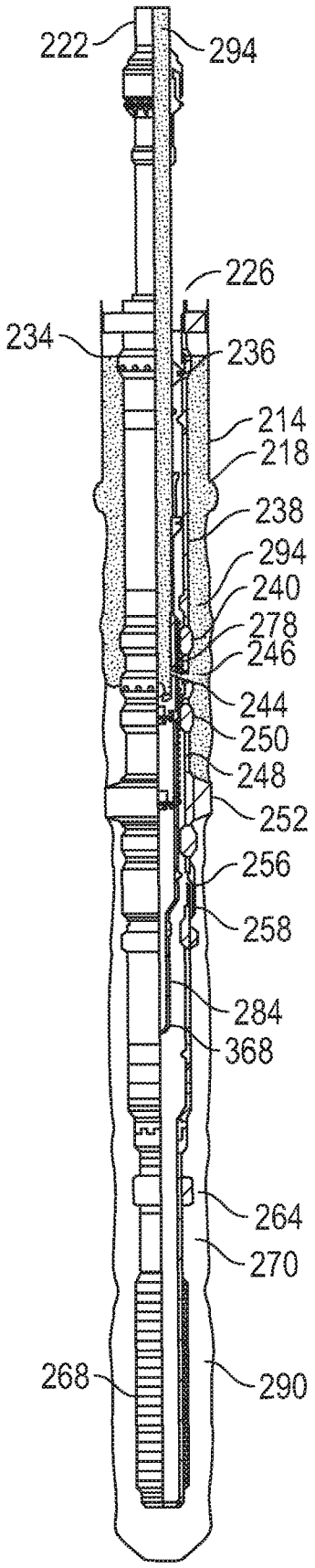
FIG. 5 is an elevation sectional view of FIG. 2, with the inner assembly in a cementing position in accordance with certain embodiments of the present disclosure.

In FIG. 5, the work string 222 has been moved into position for cementing the pipe 238 above the packer 252. The work string 222 has been first lifted to enable the fluid loss control device shifter 368 to close the fluid loss control device 264 to ensure no cement gets into the screen 268 coming down through the blank pipe 270. It can further position sleeve shifters above the sleeve valves 236 and 246. During this lifting operation, another shifter can move the sleeve 258 to close the valved port 256 to ensure that no cement can get below the valved port 256 and possibly harm the screen 268 coming down through the annulus 290. The work string 222 is then lowered to the position shown in FIG. 5. As it is lowered, shifters open the sleeve valves 236 and 246 in the upper and lower cementing ports 234 and 244. In this cementing position, the crossover port 278 is in fluid communication with the lower cementing port 244. The seal body 282 makes sealing contact with the seal bores 240 and 250, above and below the crossover port 278 respectively. In this position, cement 294 may be flowed down the work string 222, through crossover port 278 and lower cementing port 244 into the annulus 248. The cement 294 will then flow up the annulus 248 towards the upper cementing port. In this embodiment, the lower cementing port 244 includes a spring biased check valve. The spring bias may be adjusted to set a minimum pressure at which cement can be pumped through the valve and to provide positive closing of the check valve when pumping has stopped. It may be desirable to pump only enough cement to fill the annulus 248 up to about the location of the casing shoe 218, which is below the port 234. If excess cement is pumped, the excess may flow into the casing 214, through port 234 and back up the annulus 226. In some applications, e.g. shallow wells mentioned above, the blank pipe may extend a considerable distance up the well 210 and may replace casing 214. In such applications, the cementing operation may extend over the length of the pipe 238 and possibly to the surface location of the well and the upper cementing port 234 and packer 232 may be omitted. Reservoir isolation has been provided prior to the cementing operation by means of mechanically closing the valved port 256 that in this embodiment functions as a fluid loss control device positioned above the screen.

Figure 6:
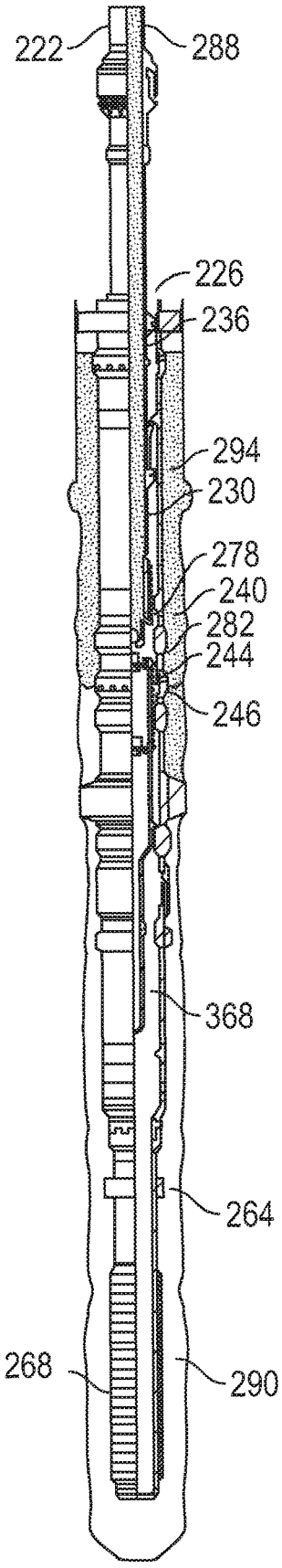
FIG. 6 is an elevation sectional view of FIG. 2, with the inner assembly in a circulation position after cementing in accordance with certain embodiments of the present disclosure.

After pumping of cement 294 is stopped, the work string 222 is again lifted a short distance to the position shown in FIG. 6. In this position, the cross over port 278 is positioned above the seal bore 240 and the seal body 282 below port 278 forms a seal with seal bore 240. Clean fluid may then be circulated down work string 222, through the port 278 and back up the annulus 226 to clean out any excess cement. If desired, the circulation may be reversed. The lower cementing port 244 includes a spring loaded check valve, which closes when the pumping of cement stops. The check valve prevents flow of cement back into the lower cementing port 244 while the work string 222 is being cleaned.

At this time the work string 222 can be lowered to enable the fluid loss control device shifter 368 to open the fluid loss control device 264 if desired. Optionally the fluid loss control device 264 can remain closed and the work string 222 used for other duties or removed from the well 210.

In this embodiment, the cementing operation is performed after the treatment operation. However, if desired the apparatus may be employed to selectively cement first and then perform the treatment operation. In either case, only one trip into the well is required. In completions with multiple screens as discussed below, it may be desirable to cement around blank pipe sections between screens. In that situation, the cementing and treatments may be performed alternately, i.e. treatment, followed by cementing, followed by treatment, etc.

After the cement has been placed as shown in FIGS. 5 and 6, the fluid loss control device 264 opened or closed as desired, and the well and work string have been cleaned out as shown in FIG. 6, the work string 222 and the inner assembly 230 may be removed completely from the well. As the inner assembly 230 is removed, shifters close the valves 236 and 246. The fluid loss control device 264 may be a ball valve, a ceramic flapper valve, or other type of fluid loss control device that may be opened or removed for production by methods known in the art. As noted above, the movements of the work string 222 have closed all three of the sleeve valves 236, 246 and 258 so that all ports in the outer assembly are closed and all produced fluids must flow through the screen 268.

Figure 7:
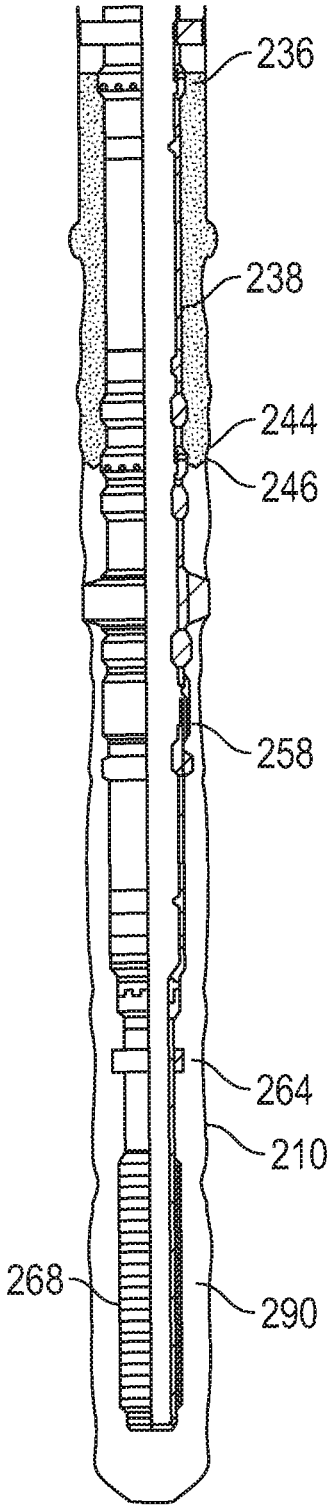
FIG. 7 is an elevation sectional view of FIG. 2, with the inner assembly removed in accordance with certain embodiments of the present disclosure.

In this FIG. 7 configuration, pipe 238 and screen 268 have been properly installed in an open-hole well 210 with a single trip into the well. The well 210 has been treated and the blank pipe 238 has been cemented without removing and/or replacing a work string or any part of a work string. The only surface operations required are relatively small vertical repositioning, i.e. lifting and lowering the work string, and flowing of appropriate treatment fluid, cement and clean out fluids.

Figure 8:
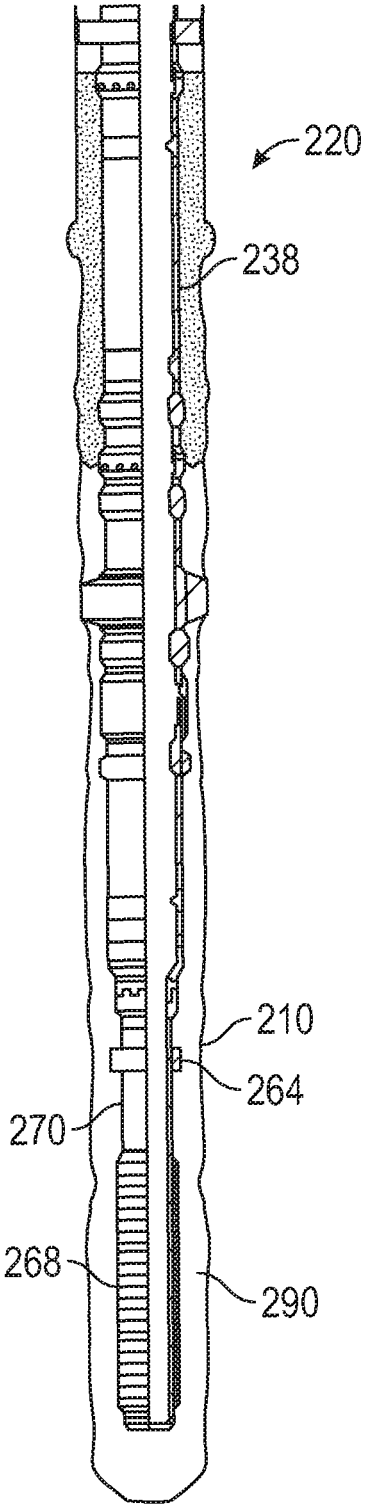
FIG. 8 is an elevation sectional view of FIG. 2, of an alternate embodiment with the inner assembly removed in accordance with certain embodiments of the present disclosure.

In FIG. 8 is shown an embodiment wherein the pipe 238 and screen 268 have been properly installed in an open-hole well 210 with a single trip into the well. The screen 268 has been placed, the well 210 treated, and the blank pipe 238 has been cemented without removing and/or replacing a work string or any part of a work string. In this embodiment the blank pipe 238 and 270 can be of the same size, or optionally the blank pipe 270 and the screen 268 can be of a larger diameter than that of the blank pipe 238.

Figure 9:
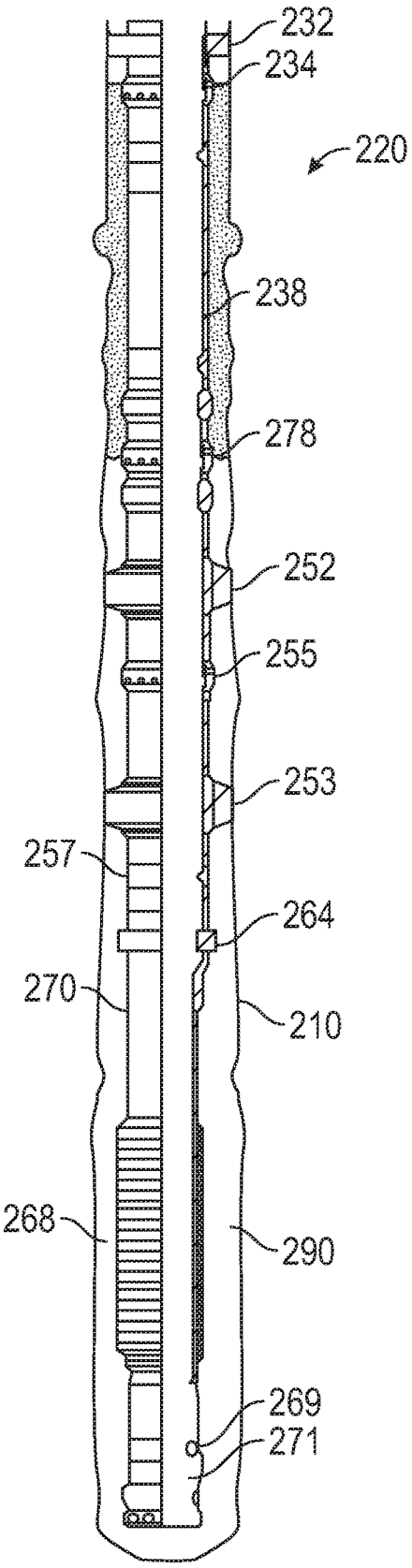
FIG. 9 is an elevation sectional view of FIG. 2, of an alternate embodiment with the inner assembly removed in accordance with certain embodiments of the present disclosure.

In FIG. 9 is shown an embodiment wherein the pipe 238 and screen 268 have been properly installed in an open-hole well 210 with a single trip into the well and enables the running of large diameter screens into an open hole well along with a liner and liner hanger on a single trip, while washing down through the toe. The system also enables an acid or other treatment to be performed through the toe and provide reservoir isolation prior to the cementing operations by means of mechanically closing a fluid loss control device positioned above an upper most screen joint.

The system components include a liner packer hanger 232, to secure the liner 238 to the casing 214 located above the open hole to be completed. A return flow circulating sleeve 234, shown as a Circulating Mechanical Closing Sleeve (MCS) 234, allows circulation of completion fluid up-hole while displacing the cement to isolate and direct the flow path down the service tool assembly 220 while circulating the cement. Also shown is a Cementing Mechanical Closing Sleeve (C-MCS) 278 that contains ports to allow for cement to go out into the open hole 210 and liner OD annular space. Also shown is Open Hole Packers 252, 253 which together isolates the open hole 210 and liner OD annular space below the C-MCS 278 to prevent cement from getting on the lower section of the assembly 220 such as the screens 268. A Testing Mechanical Closing Sleeve (MCS) 255 is placed in between the two open hole packers 252, 253 to allow pressure testing of the sealing elements of the open hole packers 252, 253 against the open hole 210 prior to a cementing operation. A Lower Seal Bore 257 provides a means to isolate/direct flow path down the service tool while washing down and pumping the acid treatment. A Fluid Loss Control Device (FLD) valve 264 isolates the formation once the acid treatment operation is finalized. This valve 264 can be a ball valve, flapper valve, or any other valve assembly that can serve the purpose. Hydraulic Activated Screen joints 268 allow the system to be run without wash pipe while still keeping the wash-down capability. Once activated the hydraulic activated screens 268 act like regular screens during the production phase. A Hydraulic Screen activation device 269 enables the operator to build enough pressure to hydraulically activate the screens 268. A Float Shoe assembly 271 can contain a double poppet check valve that allows flow to pass through one direction only while washing down.

As shown in FIG. 9 the screen 268 has been placed and the blank pipe 238 has been cemented in a single trip in the well. In this embodiment the blank pipe 238 and 270 can be of the same size, or optionally the blank pipe 270 and the screen 268 can be of a larger diameter than that of the blank pipe 238. In this embodiment there are two open hole packers 252, 253 and a testing mechanical closing sleeve 255 is located between the two open hole packers 252, 253. The testing mechanical closing sleeve 255 allows pressure testing of the sealing elements against the open hole 210 prior to the cementing operation. This can ensure that the cementing of the blank pipe 238 does not allow any cement to get below the open hole packers 252, 253 and potentially hinder the screens 268.

Figure 10:
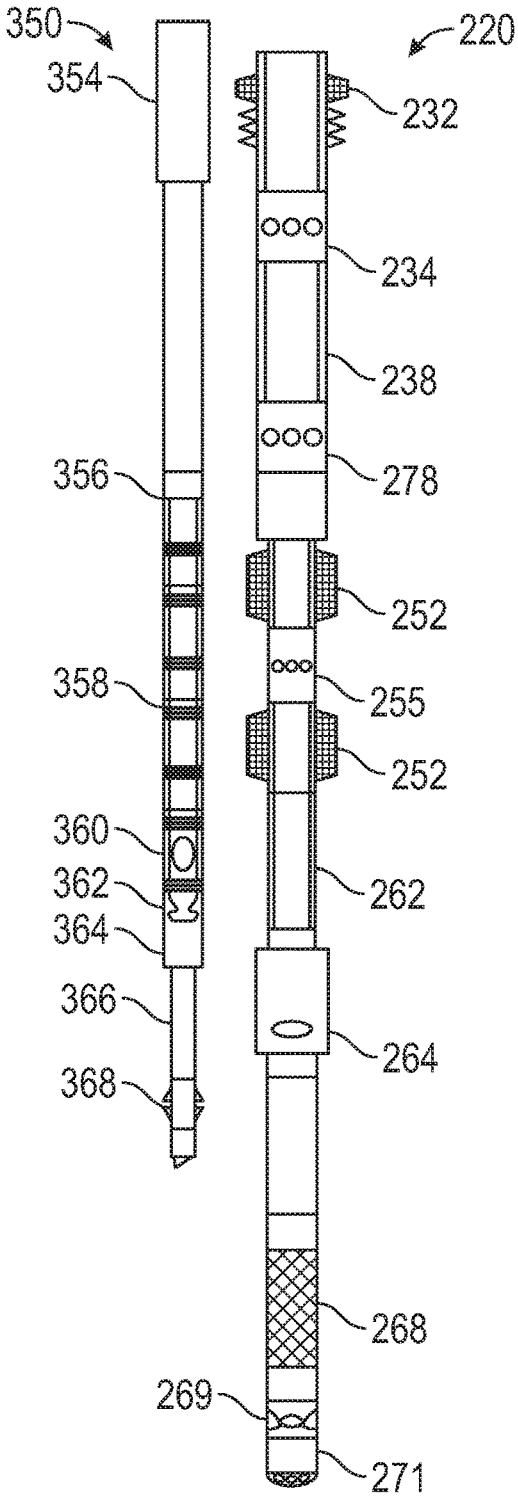
FIG. 10 is an elevation sectional view of a setting tool in accordance with certain embodiments of the present disclosure.
Figure 12A:
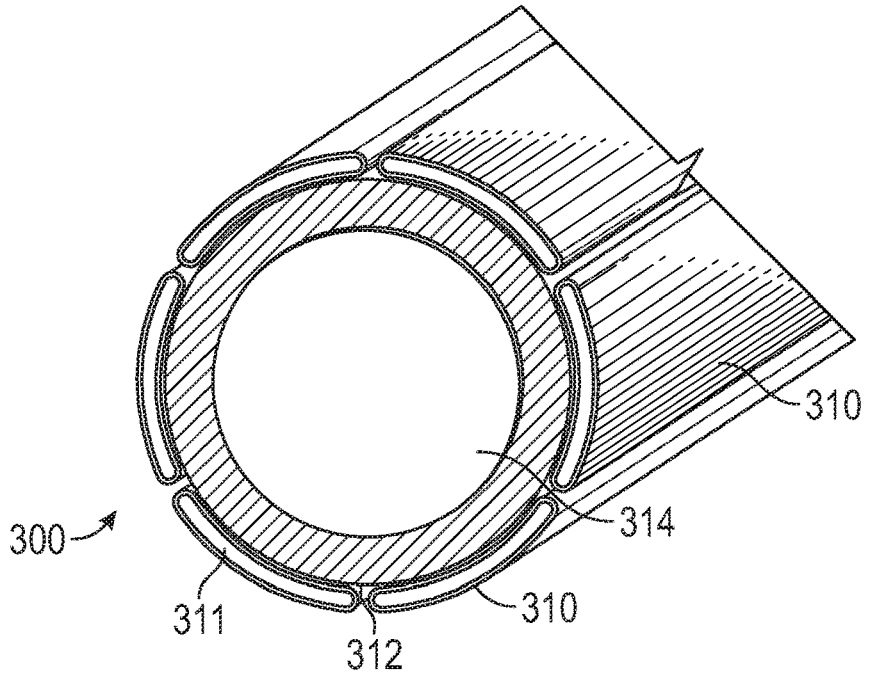
FIG. 12*a* through 12*d* illustrate cross-sectional views of an expandable screen assembly according to an embodiment.
Figure 12B:
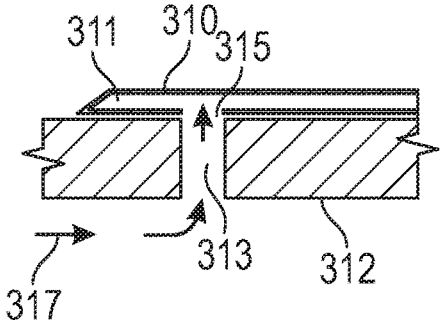
Figure 12C:
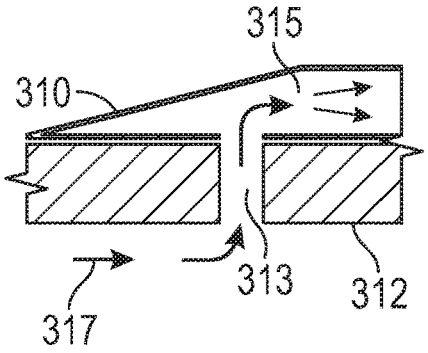
Figure 12D:
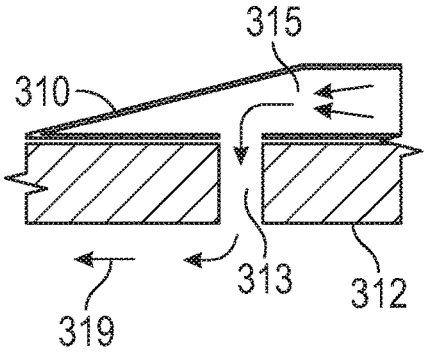

FIG. 10 illustrates a service tool 350 that can be used with an embodiment of the assembly 220. The service tool can include a liner hanger setting tool 354 for the setting of the liner hanger/packer 232. The service tool 350 further includes one or more circulation ports 356, one or more seal assembly 358, a cross-over port 360, a ball seat 362, a MCS shifter 364, a reduced diameter extension 366 and a fluid loss device FLD shifter 368. The assembly 220 includes circulating MCS 234, liner 238, and cementing MCS 278. The assembly 220 further includes open hole packers 252, a testing MCS 255, seal bore 262, fluid loss device 264, screen assembly 268, screen activation device 269, and float shoe 271.

In an embodiment, the operational procedure is as follows: Pick up and run in the well with screen 268, tool assembly 220 and service tool 350 on a tool string as per standard running procedures. Upon reaching total depth pick up the tool string 220 and slack off weight. Perform a treatment operation by circulating a delayed acid down the float shoe 271 and spotting a breaker fluid across the open hole 210. Initiate a hydraulic screen activation by dropping a ball or sending a pressure signal to the screen isolation device 269. Pressure up the service tool to set the packer/liner hanger 232 and shear off the activation feature on the Hydraulic Activated Screens 268. Continue pressuring up to release the setting tool 350 from packer/liner hanger 232 and pick up to confirm new free up weight. Pick up with the service tool 350 to position the FLD shifting tool 368 through the FLD shifting profile and close the FLD valve 264. Monitor for losses for 15 min to confirm isolation of the formation. Pick up the service tool 350 to packer-test position and pressure test the packer/liner hanger 232 on the annulus side. Drop a cross over ball to isolate the service tool below the cross over 360 and divert flow out through the cross over ports 361. Pick up with the service tool 350 to position the cross-over ports 361 between the two open hole packers 252, 253. Pressure up the service tool to set the open hole packers 252, 253. Pick up to get the T-MCS positioning tool 358 above the T-MCS 255 and slack off back down to open T-MCS 255. Reposition the cross-over ports 361 across the T-MCS 255 open ports and pressure up to test the open hole packer elements. Move tool further up to close the T-MCS 255 and open the Circulating MCS 234 and the Cementing MCS 278. Locate the weight-down cement circulating position using the weight down indicator collet. Pump the cement down the service tool 350, out through the cross-over ports 361 and out through the cementing MCS 278 while taking returns through the circulating MCS 234 above (the cement might be chased by a foam ball to provide mechanical separation of fluids). Once cement is pumped in place, pick up with the service tool 350 to position and reverse circulate excess cement up through the tool string. Pick up with the service tool 350 to close the cementing MCS 278 and the circulating MCS 234. POOH with the service tool 350 and resume any subsequent completion operations.

FIG. 11*a* through 11*f* show cross-sectional views and sectional views of an expandable screen assembly 300 according to an embodiment, at its Run-in state 302, Activation state 304, and Production state 306. At the run-in state 302 the expandable screen 310 is compressed against the base pipe 312 and the assembly has an open flow path 314 therethrough. Fluid flow can be circulated through the assembly 300 if needed to wash down through the wellbore to get to the desired setting depth. The screen assembly 300 can be run in the well with the liner in a single trip on a work string. Pressure can be applied to the work string to set the top hanger packer, release the running tool, set the open hole isolation packers (if hydraulic isolation packer is used) and to put the screen in the activation state 304. Pressure can be bled off and then re-applied to extend the screen 310 to the borehole wall. During the activation state 304 fluid flow through the bottom of the assembly 300 is blocked and hydraulic pressure applied to the assembly 300 can expand the internal members 316 and expand the screen 310. With the screen 310 activated and the pressure bled off, the assembly will convert to the production state 306 to allow fluid production from the formation, through the activated screen 310 and base pipe 312, through the liner and into the cased wellbore/production tubulars. In an embodiment the screen assembly 300 can be the Endurance Hydraulic Screen® assembly available from Halliburton of Houston Tex. Although the Endurance Hydraulic Screen® assembly is shown and described herein, other versions of screen systems can be used within the scope of this disclosure.

Figure 14A:
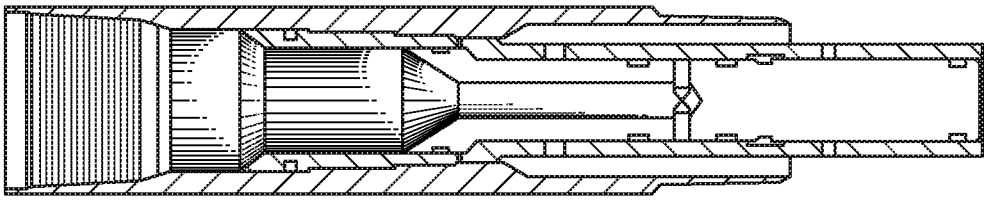
FIG. 14*a* through 14*b* illustrate cross-sectional views of a downhole shutoff collar assembly according to an embodiment.
Figure 14B:
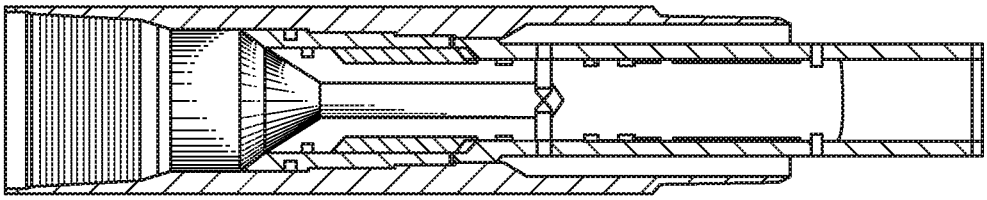
Figure 15:
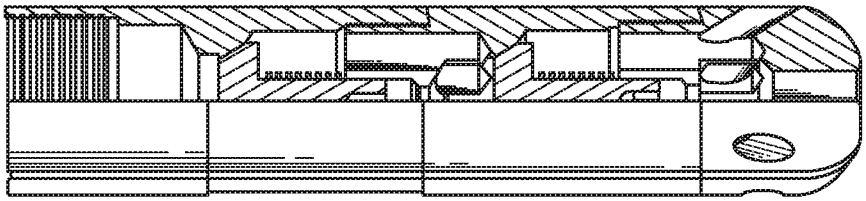
FIG. 15 illustrates an elevation view of a double sideport float shoe assembly according to an embodiment.

To activate the screen assembly 300 the bottom end of the screen assembly 318 will typically need to be isolated. Several options are available to seal off the bottom of the screen assembly. A downhole shutoff collar as shown in FIG. 9 can be used. FIGS. 14*a* and 14*b* illustrate a downhole shutoff collar that can be run at the end of the screen assembly. The downhole shutoff collar provides a fluid flow path for washing down the assembly with the ability to be shut off and seal the end of the assembly so that hydraulic pressure can be applied to activate the screen. The downhole shutoff collar coupled with a double sideport float shoe as shown in FIG. 15 will allow circulation/washdown while running the assembly into the well. A ball can be dropped from the surface to actuate the shut off and isolate the float shoe. It will provide a liner/screen assembly pressure seal enabling the setting of the packers and the activation of the screen.

FIG. 12*a* through 12*d* show cross-sectional views of an expandable screen assembly 300 according to an embodiment. A screen element 310 is shown on the exterior of a base pipe 312, the base pipe defining a passageway therethrough 314. In FIG. 11*b* is shown a screen element 310 in a collapsed position, the screen forming a flattened cavity 311. The base pipe 312 contains passageways 313 that allow a fluid flow as shown by arrows 317 to enter and pressure up the cavity 311. With fluid flow 315 the pressure in the cavity 311 increases and expands the screen element 310 as in shown in FIG. 11*c*. Once the screen 310 is expanded the screen assembly 300 can be put into a production mode as shown in FIG. 11*d* where fluid flow 315 from the screen 310 flows through the passageways 313 and is flow within the base pipe 319.

Figure 13:
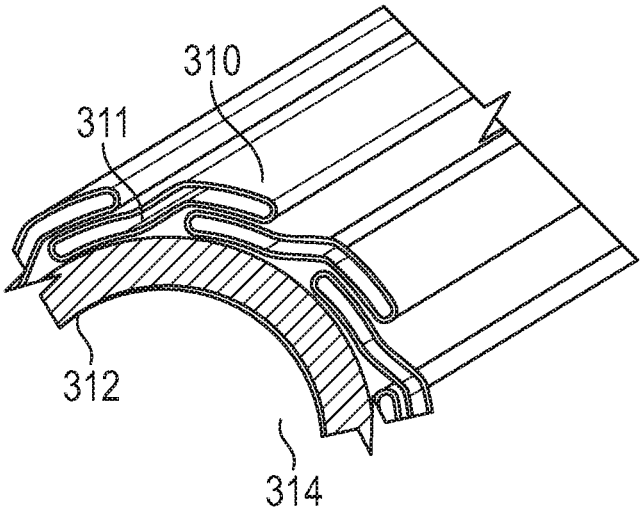
FIG. 13 is a cross-sectional view of an alternate expandable screen assembly according to an embodiment.

FIG. 13 shows a cross-sectional view of an alternate expandable screen assembly 300 according to an embodiment. A screen element 310 is shown on the exterior of a base pipe 312, the base pipe defining a passageway therethrough 314. The screen element 310 is shown in a collapsed position, the screen forming a flattened cavity 311. As fluid enters and pressures up the cavity 311 the pressure in the cavity 311 increases and expands the screen element 310. Once the screen 310 is expanded the screen assembly 300 can be put into a production mode. Many alternate expandable screen assemblies are available and are not limiting as to the application to the disclosure herein.

FIGS. 14*a-b* illustrates an elevation view of a downhole shutoff collar assembly according to an embodiment that can be run at the end of the screen assembly. The shutoff collar assembly provides a fluid flow path for washing down the screen assembly that can be used to facilitate the one trip method disclosed herein.

FIG. 15 illustrates an elevation view of a double sideport float shoe assembly according to an embodiment that can be run at the end of the screen assembly. The float shoe provides a fluid flow path for washing down the screen assembly that can be used to facilitate the one trip method disclosed herein.

Figure 16A:
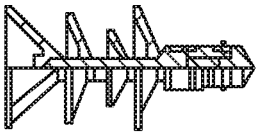
FIG. 16*a* through 16*b* illustrate an elevation view of a dart and a wiper plug assembly attached to a liner hanger setting tool according to an embodiment.
Figure 16B:
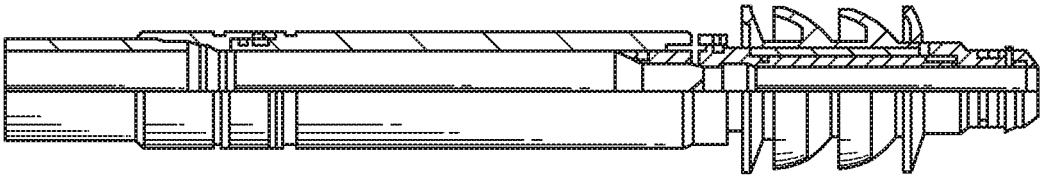
Figure 17:
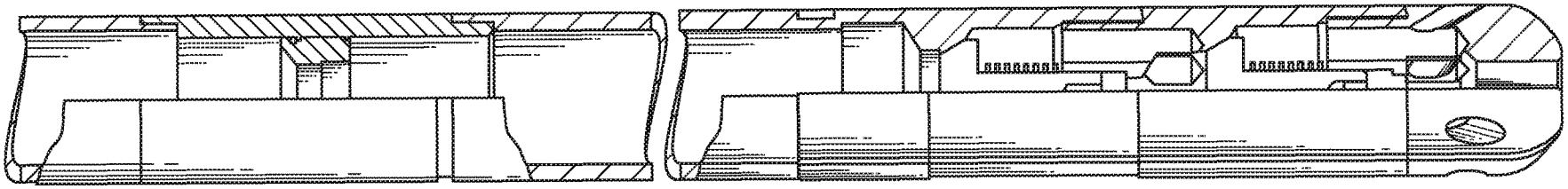
FIG. 17 illustrates an elevation view of a landing collar with a double sideport float shoe assembly according to an embodiment.

FIGS. 16*a-b* illustrate a dart and a wiper plug attached to a liner hanger setting tool that can be used to facilitate the one trip method. A wiper plug and landing collar could be used to isolate the float shoe assembly. A dart can be dropped from the surface to land on the wiper plug assembly in the hanger setting tool. Pressure can be applied to expend the wiper plug assembly to the bottom landing collar as shown in FIG. 17. The float shoe will be isolated enabling pressure to be applied to set the hanger/packers and activate the screen assembly.

FIG. 17 illustrates a landing collar with double sideport float shoe assembly that can be used to facilitate the one trip method disclosed herein.

Figure 18:
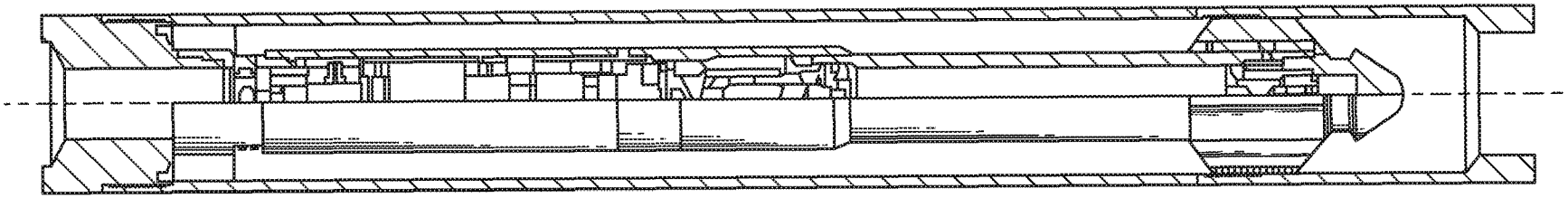
FIG. 18 illustrates an elevation view of an eRED® plug assembly according to an embodiment available from Halliburton of Houston, Tex.

FIG. 18 illustrates an elevation view of an eRED® plug assembly according to an embodiment available from Halliburton of Houston Tex. The eRED® plug assembly contains an electrical activation element that can be actuated by a signal such as a pressure or temperature change, a timer, or other signal. The eRED® plug combined with a double sideport float shoe can enable the circulation of fluids down through the shoe while running in the hole. The eRED® can then be triggered to close (possible trigger: hydrostatic pressure or timer or applied pressure or combination thereof), isolate the float shoe and allow pressure to be applied to set the hanger/packers and activate the screen.

The above operational procedures are meant to be non-limiting examples of a procedure that could be employed to achieve the desired results of the discloser herein. Alternate procedures may also be employed to likewise achieve the desired results of the discloser herein.

In some cases the liner may not need to be cemented in place, which can be accommodated by the setting of two packers on either end of the liner. These may be pressure activated or chemically activated annular barriers. If the liner requires cementing the work string and service tool can be picked up to open the return flow circulation device and place the service tool into the backflow circulating device above the open hole packer to circulate cement around the liner.

This system provides a sand control solution in a single trip with an intermediate liner while keeping the capability of isolating or/and cementing the liner if desired. This system provides a sand control solution without necessarily having to perform a gravel pack with a considerable reduction of operational risk and cost. Such method will also generally reduce rig time and the related overall cost of well construction and completion.

An embodiment of the present disclosure is a method for placing a screen, a fluid loss control device, and liner in a well in a single trip. The method includes running into the well a work string having a liner, liner hanger, at least one open-hole packer, a fluid loss control device, and a screen assembly and positioning the screen assembly and liner within the well. The method can further include closing the fluid loss control device and cementing the liner within the well without removing the work string from the well between cementing and positioning the liner and screen assembly. The method can further include actuating a screen assembly and extending an expandable element of the screen assembly without removing the work string from the well between positioning and actuating the screen assembly. The disclosed method enables a larger bore screen to be run in the open hole that otherwise would be limited by the ID of the liner.

An embodiment of the present disclosure is an apparatus for one trip completion of a well that includes a screen assembly and a fluid loss control device carried on a work string, a liner carried on the work string, the screen assembly, fluid loss control device and liner operable in response to positioning of the work string in the well and/or pressure within the work string without removal of the work string from the well. The apparatus can include cementing equipment carried on the work string, the cementing equipment selectively operable in response to positioning of the work string in the well and/or pressure within the work string without removal of the work string from the well. The apparatus can include screen assembly activation equipment carried on the work string, the activation equipment selectively operable in response to positioning of the work string in the well and/or pressure within the work string to radially extend a screen without removal of the work string from the well.

In another embodiment having multiple screen assemblies, the assemblies may be connected by lengths of blank pipe. It may be desirable to block annular flow outside the lengths of blank pipe by, for example, cementing the annuli around such lengths of blank pipe. Cementing of such multiple lengths of pipe between multiple screen assemblies may be accomplished by providing upper and lower cementing ports and seal bores for each length of pipe which is to be cemented. The inner assembly may then be positioned to selectively open cementing valves and flow cement into the various annuli between the blank pipe lengths and the well bore wall.

An embodiment of the present disclosure is a method for completing a well in a single trip, that includes running into the well a liner, a liner hanger, at least one open-hole packer, a fluid loss control device, a screen assembly and a float shoe on a work string. The method includes positioning the liner, liner hanger, at least one open-hole packer, fluid loss control device, screen assembly and float shoe within the well while washing down through the float shoe, setting the liner hanger and the at least one open-hole packer and placing the screen assembly in production mode without removing the work string from the well between setting the liner hanger and at least one open-hole packer and placing the screen assembly in production mode. The method can include performing an acid treatment prior to any cementing operation.

The method can include isolating a screen section of the well from a liner section of the well by closing the fluid loss control device prior to cementing the liner within the well without removing the work string from the well. The method can optionally include isolating an annulus between the liner section and the screen section by setting at least one open-hole packer without removing the work string from the well. Alternate embodiments include actuating the screen assembly and extending an expandable element of the screen assembly without removing the work string from the well between positioning and actuating the screen assembly. They can further include setting a portion of the liner within a cased portion of the well. The method can optionally include gravel packing the well.

An alternate embodiment includes running into the well a work string comprising a plurality of liner sections and screen sections and positioning the plurality of screen sections and liner sections within the well. The individual annulus between each liner section and wellbore can be isolated either by an annular barrier device or by cementing the liner within the well without removing the work string from the well between cementing each liner section and positioning the plurality of screen sections.

An alternate embodiment is a single trip completion of a well in an open hole that includes running a work string into the well, using the work string to position a liner, a liner hanger, at least one open-hole packer, a fluid loss control device, a screen assembly and a float shoe while circulating through the float shoe. A treatment fluid such as acid can be placed at or injected into a prospective formation. Once positioned the completion includes setting the liner hanger and at least one open-hole packer, actuating the screen assembly and placing the screen assembly in production mode. Then the at least a portion of the work string is repositioned to close the fluid loss control device above the screen assembly and activate a cementing functionality of the work string. The workstring is used to isolate an annulus between the liner and the well without removing the work string from the well between the cementing operation and placing the screen assembly in production mode. The annulus between the liner and well can be isolated by cementing the liner within the well or by setting one or more annular barrier device. The method can further include actuating the screen assembly and extending an expandable element of the screen assembly without removing the work string from the well between positioning and actuating the screen assembly. The liner can be set within a cased portion of the well.

Alternate embodiments can include running into the well a work string comprising a plurality of liner sections and screen sections and positioning the plurality of screen sections and liner sections within the well, which can further include isolating the individual annulus between each liner section and wellbore either by annular barrier device or cementing the liner within the well without removing the work string from the well between cementing each liner section and positioning the plurality of screen sections.

A further embodiment is an apparatus for one trip completion of a well that includes a screen assembly, liner, a fluid loss control device and cementing equipment carried on a work string. The screen assembly, liner, fluid loss control device and cementing equipment selectively operable in response to positioning of portions of the work string in the well and/or pressure within the work string without removal of the work string from the well. The apparatus can include screen assembly activation equipment carried on the work string, the activation equipment selectively operable in response to positioning of the work string in the well and/or pressure within the work string to radially extend a screen without removal of the work string from the well. The apparatus can include a plurality of liner sections and screen sections, and can optionally include sufficient ports and sleeves for isolating each individual annulus between each liner section and wellbore either by annular barrier device or cementing the liner within the well without removing the work string from the well between cementing each liner section and positioning the plurality of screen sections.

The operations of the steps are described with reference to the systems/apparatus shown described herein. However, it should be understood that the operations of the steps could be performed by embodiments of systems and apparatus other than those discussed herein and are not meant to be limiting. Embodiments discussed herein could perform alternate operations different than those discussed but achieving substantially similar results.

The text above describes one or more specific embodiments of a broader disclosure. The disclosure also is carried out in a variety of alternate embodiments and thus is not limited to those described here. The foregoing description of an embodiment of the disclosure has been presented for the purposes of illustration and description. It is not intended to be exhaustive or to limit the disclosure to the precise form disclosed. Many modifications and variations are possible in light of the above teaching. It is intended that the scope of the disclosure be limited not by this detailed description, but rather by the claims appended hereto.

What is claimed is:

1. A method for completing a well in a single trip, comprising:

running into the well a liner, a liner hanger, at least one open-hole packer, a screen assembly, an inner assembly having a wash pipe and a fluid loss control device shifter, a fluid loss control device, and a double-poppet valve float shoe assembly on a work string;

performing an acid treatment by circulating fluid through the double-poppet valve float shoe assembly;

positioning the wash pipe and the fluid loss control device shifter above the screen assembly;

subsequent to positioning the wash pipe and the fluid loss control device shifter above the screen assembly and performing the acid treatment, closing the fluid loss control device without removing the work string from the well by lifting the work string to cause the fluid loss control device shifter to close the fluid loss control device; and performing a cementing operation within the well subsequent to closing the fluid loss control device.

2. The method of claim 1, further comprising: isolating a screen section of the well, wherein the screen section of the well includes the screen assembly, from a liner section of the well, wherein the liner section of the well is between a top end of the liner and the at least one open-hole packer, by closing the fluid loss control device above the screen assembly and below the open-hole packer after performing the acid treatment and prior to cementing the liner within the well without removing the work string from the well.

3. The method of claim 1, further comprising: isolating an annulus between a liner section of the well and a screen section of the well by setting the at least one open-hole packer without removing the work string from the well.

4. The method of claim 1, further comprising: setting a portion of the liner within a cased portion of the well.

5. The method of claim 1, further comprising: placing the screen assembly in a production mode and closing the fluid loss device includes closing the fluid loss device using the wash pipe that does not extend to the screen.

6. The method of claim 1, wherein the work string comprises a plurality of liner sections and a plurality of screen sections and wherein the method further comprises positioning the plurality of screen sections and the plurality of liner sections within the well.

7. The method of claim 6, further comprising: isolating an annulus between one of the plurality of liner sections and the well by cementing the one of the plurality of liner sections within the well without removing the work string from the well between isolating the annulus and positioning the plurality of screen sections.

8. The method of claim 1, wherein the wash pipe and the fluid loss control shifter remain positioned above the screen assembly during the method of completing the well.

9. The method of claim 1, wherein the flow control device is a flapper valve or a ball valve.

10. The method of claim 1, further comprising placing the screen assembly in production mode subsequent to performing the acid treatment.

11. The method of claim 1, wherein the screen assembly is a hydraulic activated screen and the method further comprises activating the hydraulic activated screen.

12. A method for single trip completion of a well in an open hole, comprising:

running a work string into the well;

using the work string to position a liner, a liner hanger, at least one open-hole packer, an inner assembly having a wash pipe and a fluid loss control device shifter, a fluid loss control device, a screen assembly and a double-poppet valve float shoe in the well while circulating fluid through the double-poppet valve float shoe;

performing an acid treatment by circulating fluid through the double-poppet valve float shoe;

setting the liner hanger and the at least one open-hole packer;

repositioning at least a portion of the work string to activate an isolation functionality of the work string;

placing the screen assembly in production mode subsequent to performing the acid treatment;

positioning the wash pipe and the fluid loss control device shifter above the screen assembly;

subsequent to positioning the wash pipe and the fluid loss control device shifter above the screen assembly and performing the acid treatment, closing the fluid loss device without removing the work string from the well by lifting the work string to cause the fluid loss control device shifter to close the fluid loss control device; and performing a cementing operation within the well subsequent to closing the fluid loss control device.

13. The method of claim 12, further including isolating an annulus between the liner and the well by setting the liner hanger and cementing the liner below the liner hanger.

14. The method of claim 12, wherein isolating an annulus between the liner and the well is achieved by setting the at least one open-hole packer.

15. The method of claim 12, wherein placing the screen assembly in a production mode is performed without removing the work string from the well.

16. The method of claim 12, further comprising: setting a portion of the liner within a cased portion of the well.

17. The method of claim 12, further comprising closing the fluid loss control device after performing the acid treatment.

18. The method of claim 12, wherein the work string comprises a plurality of liner sections and a plurality of screen sections and wherein the method further comprises positioning the plurality of screen sections and the plurality of liner sections within the well.

19. The method of claim 18, further comprising: isolating an annulus between one of the plurality of liner sections and the well either by the at least one open-hole packer or by cementing one of the plurality of liner sections within the well without removing the work string from the well.

20. The method of claim 12, wherein the wash pipe and the fluid loss control shifter remain positioned above the screen assembly during the method of single trip completion of the well.

* * * * *